United States Patent [19]

Williams et al.

[11] 4,398,470

[45] Aug. 16, 1983

[54] WALL SAFE

[75] Inventors: Alvin R. Williams, Spencerport; Douglas E. Shaffer, Rochester, both of N.Y.

[73] Assignee: John D. Brush & Co., Inc., Rochester, N.Y.

[21] Appl. No.: 357,707

[22] Filed: Mar. 12, 1982

[51] Int. Cl.[3] ..... E05G 1/04; E05G 1/00; E05B 37/00

[52] U.S. Cl. ..... 109/52; 109/45; 109/74; 70/284; 206/1.5

[58] Field of Search ..... 109/24, 45, 47, 49, 109/50, 51, 52, 66, 74; 312/107.5, 333; 206/1.5; 70/284, DIG. 71; 232/43.2

[56] References Cited

U.S. PATENT DOCUMENTS

| | | | |
|---|---|---|---|
| 252,154 | 1/1882 | Temple et al. | 312/273 |
| 435,310 | 8/1890 | King . | |
| 714,458 | 11/1902 | Dalton | 70/284 |
| 741,724 | 10/1903 | Schulze . | |
| 744,858 | 11/1903 | Durnbaugh . | |
| 1,240,981 | 9/1917 | Kohl | 109/52 |
| 1,299,199 | 4/1919 | Lypka . | |
| 1,340,377 | 5/1920 | Cott . | |
| 1,836,814 | 12/1931 | Rauwald . | |
| 2,410,475 | 11/1946 | Anderson | 109/52 |
| 2,450,722 | 10/1948 | Drije | 248/311.2 |
| 2,604,259 | 7/1952 | Anderson | 109/73 |
| 3,070,046 | 12/1962 | Paulos | 109/59 |
| 3,146,739 | 9/1964 | Furman . | |
| 3,443,851 | 5/1969 | Earl . | |
| 3,610,176 | 10/1971 | Fujiki | 109/52 |
| 3,827,775 | 8/1974 | Arrogante . | |
| 4,186,977 | 2/1980 | Gilovich et al. | 109/52 |

FOREIGN PATENT DOCUMENTS

| | | | |
|---|---|---|---|
| 2503491 | 8/1976 | Fed. Rep. of Germany | 70/284 |

*Primary Examiner*—Robert Peshock
*Assistant Examiner*—John Weiss
*Attorney, Agent, or Firm*—Stonebraker, Shepard & Stephens

[57] ABSTRACT

A wall safe 10 uses an open front steel cabinet 20 mounted flush within a wall with a lock assembly 30 secured in one region and a portable deposit box 50 removably locked in place within another region. Lock assembly 30 includes a combination lock 24, an operating arm 35 enabled to turn when combination lock 24 is open, and a pair of live bolts 25 linked together for movement by arm 35 between locked and unlocked positions. A pair of dead bolts 19 arranged on an inner wall of cabinet 20 opposite live bolts 25 cooperate with lock assembly 30 in holding deposit box 50 securely in place. Opposite ends of the deposit box have internal steel channels 54 and 55 enclosing recesses into which the live and dead bolts enter through apertures 60 in the side walls of box 50. When locked, live bolts 25 pin together lock assembly 30, a crossbar 16 at the back of cabinet 20, and deposit box 50, making the system highly resistant to attack.

12 Claims, 4 Drawing Figures

WALL SAFE

BACKGROUND

Wall safes have oridinarily been made as cabinets built flush into a wall with a front door carrying a lock on which the security of the safe depends. Once the front door is opened, the contents of a wall safe are generally accessible. Such wall safes typically use a combination lock; and the lock, hinges, and door of the safe bear the full security burden.

We have devised a new arrangement for a wall safe that is more secure and more convenient. We have arranged a locking mechanism within one part of a wall cabinet and a deposit box in another part of the cabinet so that the locking mechanism secures the box against removal. This leaves the locking mechanism securely fixed in place, provides a lightweight, portable deposit box with a separate lock, and affords a construction more secure against attack.

The art has previously suggested ways that strong boxes could be interlocked with wall mounted brackets; but our arrangement improves over these suggestions with a stronger and more secure locking arrangement, the workings of which are not apparent on inspection. Our locking mechanism is exceptionally strong and heavy without burdening a portable deposit box that can be kept relatively light and convenient. Our invention combines these and other features into a compact, economical, effective, and highly secure system marketable at a reasonable price.

SUMMARY OF THE INVENTION

Our wall safe uses a steel cabinet sized for mounting flush within a wall and formed with a frame around an open front. A crossbar anchored within the rear of the cabinet extends along a line dividing the cabinet into a lock region and a box region. A lock assembly is enclosed within the cabinet in the lock region, and a deposit box is removably lockable within the cabinet in the box region.

The lock assembly includes a combination lock, an operating arm enabled to turn when the combination lock is open, and a pair of live bolts linked together for movement by the arm between locked and unlocked positions. A pair of dead bolts arranged on the inner wall of the cabinet opposite the live bolts cooperate with the lock assembly in holding the deposit box securely in place. Opposite ends of the deposit box have internal steel channels enclosing recesses, and outer walls of the box have bolt receiving apertures opening into the channels. The apertures are arranged so that the deposit box can be placed in the box region of the cabinet where the dead bolts extend through a pair of the apertures into the channels, and the deposit box can be locked in place by moving the live bolts through the crossbar and through another pair of apertures into the channels. The live bolts then pin together the lock assembly, the crossbar of the cabinet, and the deposit box, making the system highly resistant to attack.

The operating arm for the lock assembly preferably has a lock and is turned with a key. The same key can fit a lock that is preferably arranged on the deposit box to be disposed against the rear of the cabinet when the deposit box is locked in place.

DRAWINGS

DETAILED DESCRIPTION

Figure 2:
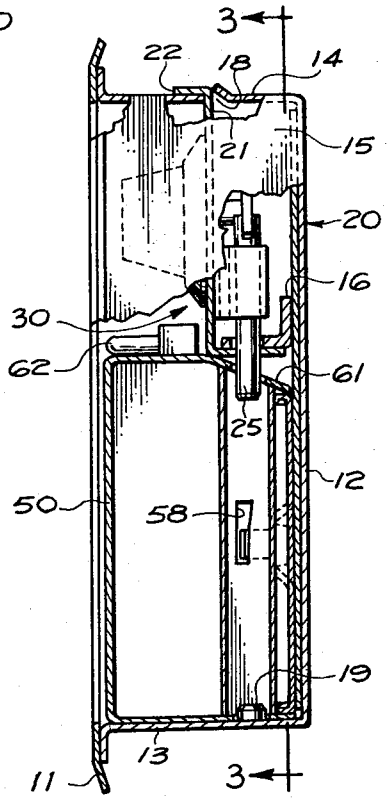
FIG. 2 is a partial cross-sectional view taken substantially along the line 2—2 of FIG. 1.
Figure 1:
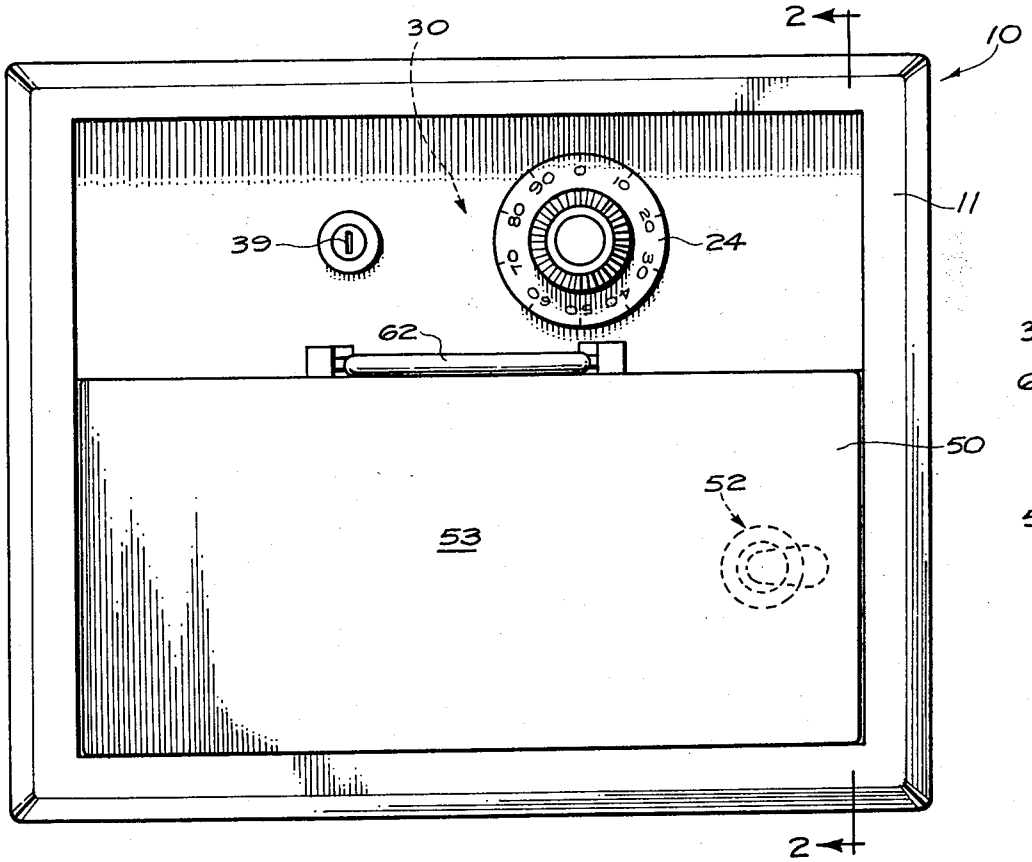
FIG. 1 is a front elevational view of a preferred embodiment of our wall safe.

As shown in the illustrated preferred embodiment, out wall safe 10 has three main components—a cabinet 20, a lock assembly 30, and a deposit box 50. Cabinet 20 is securely mounted flush within a wall, lock assembly 30 is securely arranged within an upper part of cabinet 20, and deposit box 50 is lockable within a lower region of cabinet 20 adjacent lock assembly 30. Each of these components will be explained in detail and then their interaction and operation will be described.

Cabinet 20 is sturdily formed of steel and has an open front within frame 11, a back 12 that is preferably formed of a piece punched out of frame 11, a bottom 13, a top 14, and a pair of sides 15. Cabinet 20 is preferably sized to fit between conventional wall studs spaced on 16 inch centers and is preferably installed between headers. Its bottom 13, top 14, and sides 15 are preferably provided with holes (not shown) for screwing cabinet 20 securely within a frame work in a wall so that its open front and frame 11 are flush with the wall.

An angle iron 16 preferably welded to the back 12 of cabinet 20 extends across the rear of cabinet 20 approximately along a line between lock assembly 30 and deposit box 50. It has a pair of holes 17 that receive live bolts driven down from lock assembly 30 so that the live bolts not only pin deposit box 50 in place, but also pin lock assembly 30 and deposit box 50 to cabinet 20 via angle iron 16.

Lock assembly 30 has a mounting plate 21 preferably screwed to angle iron 16 so it extends across and closes lock assembly 30. The upper end of mounting plate 21 has several tabs 22 that extend through slots 18 in upper wall 14 of cabinet 20 and interlock mounting plate 21 securely with cabinet 20. Locking mechanisms within assembly 30 are preferably mouned on plate 21.

A pair of live bolts 25 mounted in guides 26 are movable vertically relative to plate 21 for locking and unlocking safe 10. Live bolts 25 are sturdily made; and guides 26 are mounted adjacent angle iron 16 so that when live bolts 25 are in their lower locked position, they extend through guides 26 welded to plate 21, through holes 17 in angle iron 16, through holes 23 in mounting plate 21, and into deposit box 50 to pin together all the major components of the safe in a reliably strong way.

Figure 3:
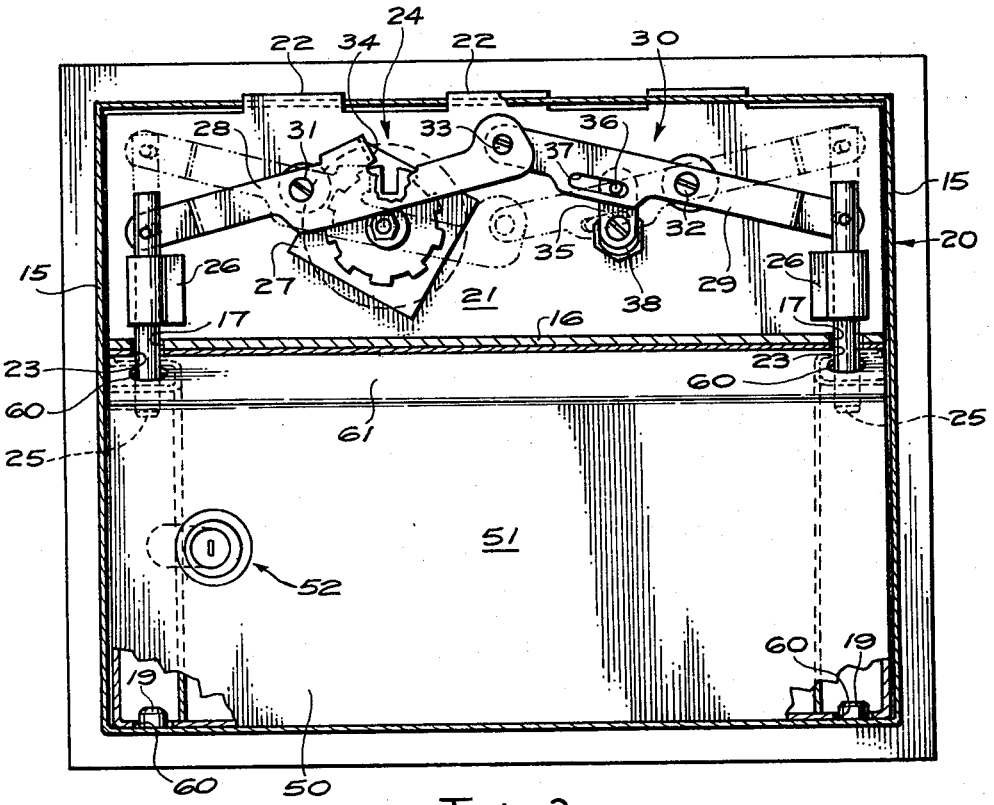
FIG. 3 is a partial cross-sectional view taken substantially along the line 3—3 of FIG. 2.
Figure 4:
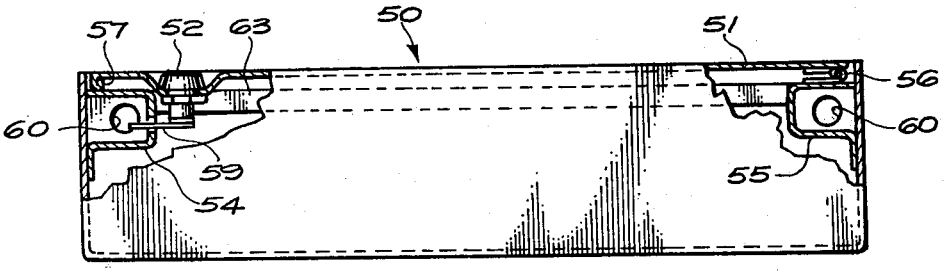
FIG. 4 is a partially cut away side view of the deposit box shown in FIGS. 1-3.

Live bolts 25 are linked for movement together when permitted by a combination lock 24. Lock 24 is preferably a secure combination lock with a hardened back plate 27 that discourages drilling. The linkage for moving live bolts 25 includes a pair of links 28 and 29 mounted on respective pivots 31 and 32. Links 28 and 29 are coupled together at their inner ends with a pin 33 and at their outer ends to live bolts 25. Appropriate slots are provided for pin connections so that pivoting links 28 and 29 between solid and broken line positions as best shown in FIG. 3 lowers live bolts 25 to a locked position and raises them to an unlocked position.

Links 28 and 29 are moved by an operating arm 35 carrying a pin 36 movable within a slot 37 in link 29. Rotating arm 35 between its illustrated positions moves links 28 and 29 and operates live bolts 25 whenever such movement is permitted by the notches of the combination wheels of lock 24 being registered with projection 34 extending from link 28.

A lock 38 preferably controls movement of operating arm 35 which can be turned only by a key (not shown) inserted into lock 38 via keyhole 39. Opening or unlocking live bolts 25 then requires proper setting of the combination of lock 24 to allow movement of projection 34 freeing links 28 and 29 for movement, followed by movement of arm 35 with a key in lock 38 to pivot the links and raise the live bolts. An operating handle could be substituted for key lock 38 to operate arm 35; but key lock 38 is preferred as simple, effective, and affording additional security beyond that provided by combination lock 24.

Deposit box 50 is stoutly made to be attack resistant in its own right, and it is securely held within the box region of cabinet 20 by lock assembly 30 so that it cannot be pried loose. Its cover 51 carries a lock 52 preferably opened by the same key that operates lock 38, and cover 51 is disposed against the back 12 of cabinet 20 when deposit box 50 is locked in place. This leaves only the smooth and uninterrupted box bottom 53 exposed when box 50 is locked in place.

A pair of steel channels 54 and 55 welded into the interior of the opposite ends of box 50 enclose recesses at each end of box 50 adjacent cover 51. A concealed hinge 56 for cover 51 is secured to channel 55, and the free end 57 of cover 51 rests against channel 54 in a closed position. Channel 54 also has a locking slot 58 that receives the locking arm 59 of lock 52 for locking cover 51 to channel 54. Jambs 63 extend along the sides of cover 51 to support and strengthen it in its closed position.

Channels 54 and 55 not only contribute to the strength and sturdiness of box 50, but they enclose a hollow recess extending vertically of box 50 when it is locked in safe 10. At each end of box 50, its outer side walls are formed with apertures 60 opening into the recesses within channels 54 and 55. Dead bolts and live bolts extend through apertures 60 into the enclosed recesses within channels 54 and 55 to lock box 50 in place.

Dead bolts 19 secured to bottom wall 13 of cabinet 20 are disposed opposite live bolts 25 so they enter into and engage one pair of apertures 60 while live bolts 25 extend downward from lock assembly 30 to enter and engage the opposite pair of apertures 60. The apertures 60 receiving live bolts 25 are formed in an inclined side surface 61 that is sloped to allow box 50 to pivot into the box region of cabiinet 20 where it can be locked in place. A handle 62 is mounted on box 50 forward of sloping surface 61 and forward of lock assembly 30 and is convenient for inserting and removing box 50 from cabinet 20.

To understand the way our wall safe 10 works, consider first deposit box 50 separated from cabinet 20. Although it is sturdily built and strongly resistant, it is light enough and small enough so it can be easily and conveniently carried by handle 62. Its lock 52 is relatively light; but its cover 51 supported by channels 54 and 55 and jambs 63 makes the box hard to enter, even when not locked in cabinet 20. This gives the user some security in carrying box 50 about while it affords a convenient and portable case for valuables.

When contents are locked away in deposit box 50, it can be stored in high security within cabinet 20. To do this, the user tilts box 50 into cabinet 20 with handle 62 on top and inclined surface 61 clearing the bottom of lock assembly 30. Then as box 50 is pivotally moved into cabinet 20, a pair of its apertures 60 move down over dead bolts 19 which extend into the recesses within channels 54 and 55 as the locked door 51 moves against the back 12 of cabinet 20. Then a key turned in lock 38 pivots links 28 and 29 and drives live bolts 25 downward through angle iron 16, lock plate 21, and apertures 60 and into the recesses within channels 54 and 55. This pins together all the components of safe 10 with sturdy live bolts 25 extending through the strongest components of cabinet 20, lock assembly 30, and deposit box 50. Cabinet 20 itself is securely anchored within a wall with concealed fasteners and cannot be removed without tearing the wall apart. Deposit box 50 has a close fit within cabinet 21 so it is not accessible to pry bars. Even then, both its side walls and channels 54 and 55 are securely interlocked with dead bolts 19 and live bolts 25 that in turn are interlocked with angle iron 16, plate 21, and guides 26. This interconnects many strong structural elements within a short distance making removal of deposit box 50 extremely difficult and time consuming.

Mounting plate 21 of lock assembly 30, besides being pinned in place by live bolts 25, is tightly fitted within cabinet 20 and connected to cabinet top 14 by tabs 22 so that it affords no purchase for a pry bar and strongly resists any attempts at opening or removal. Besides the security offered by a good quality combination lock 24, a key also is preferably required to unlock live bolts 25 so that ability to operate lock 24 is inadequate in itself to remove deposit box 50.

We claim:

1. A wall safe comprising:

a. a steel cabinet sized for mounting flush within a wall;

b. said cabinet being formed with a frame around an open front;

c. a crossbar anchored within a rear region of said cabinet and extending along a line dividing said cabinet into a lock region and a box region;

d. a lock assembly enclosed within said cabinet in said lock region;

e. a deposit box removably lockable within said cabinet in said box region;

f. said lock assembly comprising a combination lock, an operating arm enabled to turn when said combination lock is open, and a pair of live bolts linked together for movement by said arm between locked and unlocked positions;

g. said crossbar having a pair of holes registered with said live bolts, so that when said live bolts are in said locked position, said live bolts extend through said holes to lock said live bolts and said lock assembly to said cabinet;

h. a pair of dead bolts arranged on an inner wall of said cabinet opposite said live bolts;

i. opposite ends of said deposit box having steel channels enclosing recesses within said deposit box; and j. outer walls at opposite ends of said deposit box having bolt receiving apertures opening into said channels, said apertures being arranged so that said deposit box can be placed in said box region of said cabinet where said dead bolts extend through a pair of said apertures and into said channels, and said deposit box can be locked in place by moving said live bolts through said crossbar and through another pair of said apertures into said channels.

2. The wall safe of claim 1 wherein said deposit box closely fits within said box region of said cabinet and has an inclined surface confronting said lock assembly and oriented to allow tilted placement of said deposit box onto said dead bolts and pivotal movement of said deposit box against the rear of said cabinet while said inclined surface moves adjacent said lock assembly.

3. The wall safe of claim 2 wherein said apertures for receiving said live bolts are formed in said inclined surface of said deposit box.

4. The wall safe of claim 3 including a carrying handle arranged on said deposit box adjacent said inclined surface and disposed forward of said lock assembly when said deposit box is locked in place.

5. The wall safe of claim 1 wherein said deposit box has a cover with a lock, said cover is disposed against the rear of said cabinet when said deposit box is locked in place, one of said channels within said deposit box has a locking slot, and said lock for said cover of said deposit box locks into said slot in said channel.

6. The wall safe of claim 1 wherein said operating arm for said lock assembly is turned by a key fitting a lock or said arm.

7. The wall safe of claim 6 wherein said deposit box has a cover with a lock, said cover is disposed against the rear of said cabinet when said deposit box is locked in place, one of said channels within said deposit box has a locking slot, said lock for said cover of said deposit box locks into said slot in said channel, and said key for said operating arm lock also fits said lock for said cover of said deposit box.

8. The wall safe of claim 1 including means for securing said lock assembly to said crossbar, supporting tabs of said lock assembly interlocking with said cabinet opposite said support bar, and guides for said live bolts mounted on said lock assembly and disposed adjacent said crossbar.

9. The wall safe of claim 8 wherein said deposit box closely fits within said box region of said cabinet and has an inclined surface confronting said lock assembly and oriented to allow tilted placement of said deposit box onto said dead bolts and pivotal movement of said deposit box against the rear of said cabinet while said inclined surface moves adjacent said lock assembly.

10. The wall safe of claim 9 wherein said deposit box has a cover with a lock, said cover is disposed against the rear of said cabinet when said deposit box is locked in place, one of said channels within said deposit box has a locking slot, and said lock for said cover of said deposit box locks into said slot in said channel.

11. The wall safe of claim 10 wherein said apertures for receiving said live bolts are formed in said inclined surface of said deposit box and including a carrying handle arranged on said deposit box adjacent said inclined surface and disposed forward of said lock assembly when said deposit box is locked in place.

12. The wall safe of claim 11 wheein said operating arm for said lock assembly is turned by a key fitting a lock for said arm, and said key for said operating arm lock also fits said lock for said cover of said deposit box.

* * * * *